US007099485B2

(12) United States Patent
Dittli

(10) Patent No.: US 7,099,485 B2
(45) Date of Patent: Aug. 29, 2006

(54) HOUSING FOR HEARING DEVICES OR HEARING AIDS

(75) Inventor: Erich Dittli, Reichenburg (CH)

(73) Assignee: Phonak AG, Stafa (CH)

( * ) Notice: Subject to any disclaimer, the term of this patent is extended or adjusted under 35 U.S.C. 154(b) by 112 days.

(21) Appl. No.: 10/797,842

(22) Filed: Mar. 10, 2004

(65) Prior Publication Data

US 2005/0201580 A1 Sep. 15, 2005

(51) Int. Cl.
*H04R 25/00* (2006.01)

(52) U.S. Cl. ..... 381/322; 381/324

(58) Field of Classification Search ..... 381/322–324, 381/328, 330; 181/128–130
See application file for complete search history.

(56) References Cited

U.S. PATENT DOCUMENTS 4,272,591 A * 6/1981 Brander ..... 429/98

* cited by examiner

*Primary Examiner*—Suhan Ni
(74) *Attorney, Agent, or Firm*—Pearne & Gordon LLP

(57) ABSTRACT

An easily assemblable and cost efficient removable cap is provided in a housing for hearing devices or hearing aids respectively with sound amplifying components arranged at the inside of the housing with at least one opening arranged on the housing. The removable cap is a one-piece element with outwardly protruding pins, and it covers the opening. Grooves are also provided in the vicinity of the opening with dead stops, wherein said pins are insertable into the grooves from the inside of the housing but are jammed from being pulled outside of the housing by said dead stops in order to prevent any unintentional or independent loosening of the cap.

9 Claims, 2 Drawing Sheets

HOUSING FOR HEARING DEVICES OR HEARING AIDS

CROSS-REFERENCE TO RELATED APPLICATIONS

Not Applicable

STATEMENT REGARDING FEDERALLY SPONSORED RESEARCH OR DEVELOPMENT

Not Applicable.

INCORPORATION-BY-REFERENCE OF MATERIAL SUBMITTED ON A COMPACT DISC

Not Applicable.

BACKGROUND OF THE INVENTION

1. Field of the Invention

This invention relates to a housing for hearing devices or hearing aids respectively with sound amplifying components arranged at the inside of the housing, at least one opening arranged at the outside and a removable cap for covering said opening.

Hearing devices or hearing aids respectively commonly consist of a closed housing or joined housing shells for its operations. As the devices are subject to a number of environmental influences during its operations, the housings, as well as multipart shells, have to be leak-proved sealed. The respective housings thus may only be opened with special tools and by respectively trained or skilled persons.

For direct interventions into the inside of the housing during operation or during short breaks of operation, without the need of opening the housing shell, closable openings will have to be provided within the housing shell. This may be the case if an electrical plug-in connection has to be established with an external unit.

2 . Description of Related Art

Such openings are provided in known hearing devices, such as behind-the-ear hearing aids, with electronic amplifying techniques, and may be closed with covers pivotably arranged at the housing. Such covers are for instance attached by means of metallic axis or pins, that are arranged leading through the cap as well as through the housing. This provides a stable connection but needs a great amount of space and is involved with relatively high production costs due to its multi-piece composition and use of different materials.

In another known embodiment a cap for closing the opening is insertable from the outside through an opening into the housing, whereby elastically hinge elements will snap into accordingly shaped recesses within the housing. The cap thus may be provided as a one-piece element but bears the risk that the cap may get loose or broken by inappropriate handling.

In another known embodiment, the openings are covered or closed by a cap having a flexible hinge or consisting of flexible material, such as rubber. Such covers disadvantageously have a self-closing effect due to its flexible and resilient characteristics of the hinge, thus closing the opening before the intended intervention through the opening has taken place.

BRIEF SUMMARY OF THE INVENTION

It is an object of the present invention to provide such a housing with a cap which may be produced without high costs and whereby the cap is secured against unintentional removing.

The present invention provides a housing for hearing devices or hearing aids respectively with sound amplifying components arranged at the inside of the housing, at least one opening arranged at the outside of the housing and a removable cap for covering said opening, whereby the cap is a one-piece element with outwardly protruding pins and that grooves are provided at the housing in the region of the opening with outwardly acting dead stops such as said pins are insertable into the grooves from the inside of the housing but are jammed in direction of the outside by said dead stops. The cap thus may not be directly pulled out from the housing to its front, thus reliably preventing an unintentional or independent loosening of the cap. However, the insertion of the cap into the housing is as well possible and may be performed even from the outside of the housing. The cap therefore has to be inserted in its twisted position with the pins in front into the opening of the housing and following twisted such that the pins will insert into the grooves at the inside of the housing. The cap may subsequently be pulled in outwardly direction into its pivotable position within the housing, as a rule against the dead stop of the grooves. In this position, the cap may close the opening or may be opened by pivoting around the axis of the pins. The cap and the pins are made as a one-piece element and may therefore advantageously and cost-efficient be manufactured for instance in plastics commercially even in great numbers.

In one embodiment the cap in the area of the pins consists of a rounded shape or of at least partially a cylindrical shape. Thus this area of the cap may be brought in contact against an accordingly shaped wall of the housing and be supported by this wall, thereby providing a great mechanical strength.

In one embodiment the pins are arranged in one axis at the cap, having circular cross sections. The axis is thereby building the pivoting axis of the cap in its inserted state. The pins therefore consist of a circular cross section and are easily insertable into the grooves and reloctable to its end positions.

In another embodiment, at least one clip is resiliently arranged at the housing, the clip being at least partially in resilient contact with the cap in its inserted state and forming a part of a pivotable hinge of the housing. The cap may snap into its end position due to the resilient clip and thus be fixed in this end position. The part of the cap being in contact with the clip at the same time constitutes a pivoting hinge together with the pins hold by the grooves. The cap thus is reliable pivoted supported and may not loosen unintentionally nor independently from its end position.

In a further embodiment, the clip is in contact with the cap in the area of the pins and/or is provided as part of the housing. The housing may be manufactured as a one-piece element with a built-in clip, and therefore the clip is made out of the same material as the housing.

In another embodiment, the housing consists of at least two detachable housing shells. In a further embodiment, those shells consist of plastics. This enables an easy and bargain production of the housing even for large numbers. The functional modules and elements may further easily be arranged and/or mounted in the inside of the housing due to the multi-part design of the housing.

The present invention further provides a hearing device or hearing aid with a housing according to the above described embodiments.

BRIEF DESCRIPTION OF THE SEVERAL VIEWS OF THE DRAWINGS

For purpose of facilitating and understanding of the invention, there is illustrated in the accompanying drawings a preferred embodiment thereof to be considered in connection with the following description. Thus the invention may be readily understood and appreciated.

DETAILED DESCRIPTION OF THE INVENTION

Figure 1:
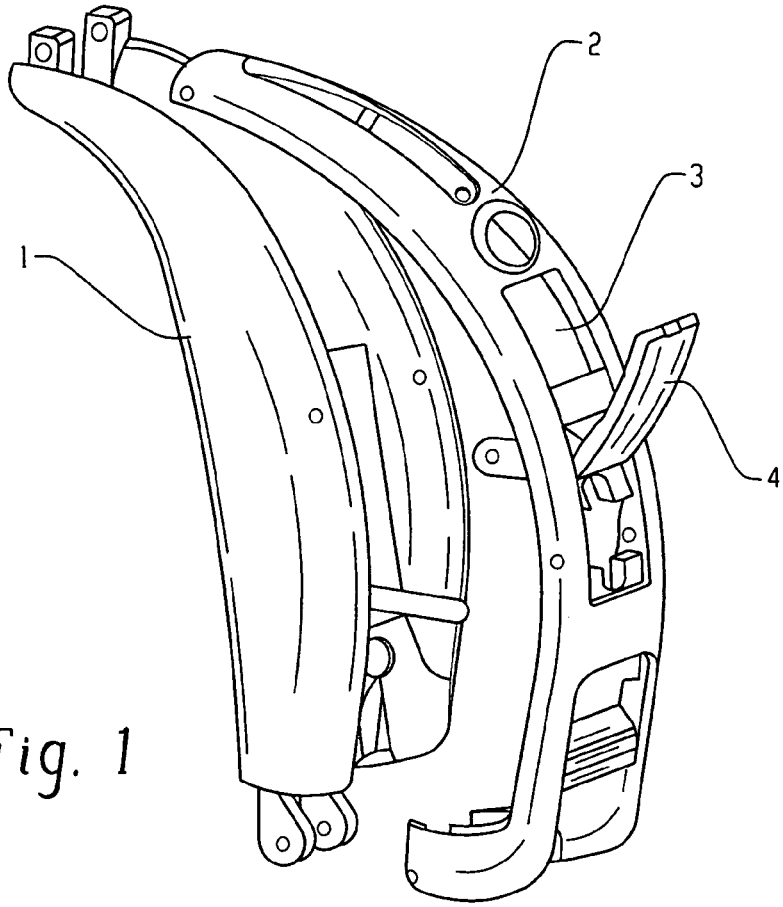
FIG. 1 is a view of an inventively shaped hearing device with the cap in its opened state.

FIG. 1 shows the view of the housing of a behind-the-ear hearing device consisting of a back shell 1 and a front shell 2. Multiple openings directed to the outside are provided at the surface of the front shell 2, inter alia the opening 3 for the external access from the outside onto electronic components arranged below the opening 3. For a better understanding, FIG. 1 only shows the back shell 1 and the front shell 2 respectively without any of the usually in the inside of the housing arranged electrical or electronically sound amplifying components.

The opening 3 may be closed by the cap 4 pivotable arranged on the front shell 2. The cap 4 his shown here in its half opened state.

Figure 2:
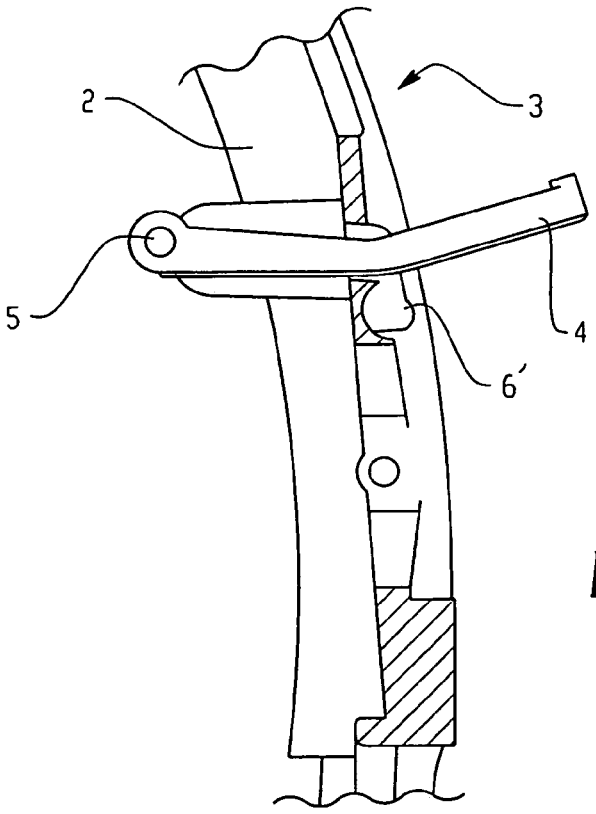
FIG. 2 is a longitudinal sectional view from the inside of the opening area of the hearing device according FIG. 1 with the cap in its insertion position.

FIG. 2 shows in more details the longitudinal sectional view of the area of the opening 3. The cap 4 may be pulled from the inside to the outside of the front shell 2 through the opening 3. Two pins 5 are arranged at the underside 4' of the cap 4 protruding to the outside. These pins 5 may be inserted from the inside into the grooves 6 arranged at the edge of the opening 3 in the wall of the front shell 2. Those grooves 6 are open towards the inside of the housing and runs preferably in form of a Z within the wall of the shell 2, as shown in FIG. 2.

Figure 3:
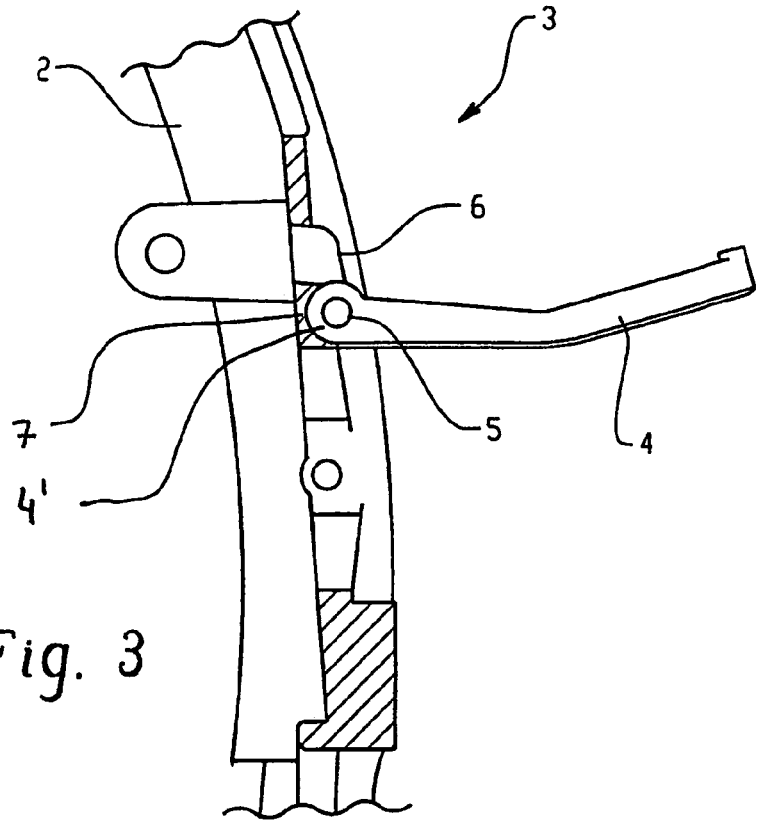
FIG. 3 is a longitudinal sectional view according FIG. 2 with the cap in its snapped in end-position in its open state.

The cap 4 may now be shifted along the grooves 6 to its position shown in FIG. 3. The pins 5 of the cap 4 thereby reaching the dead stop 6' of the groove 6.

Figure 4:
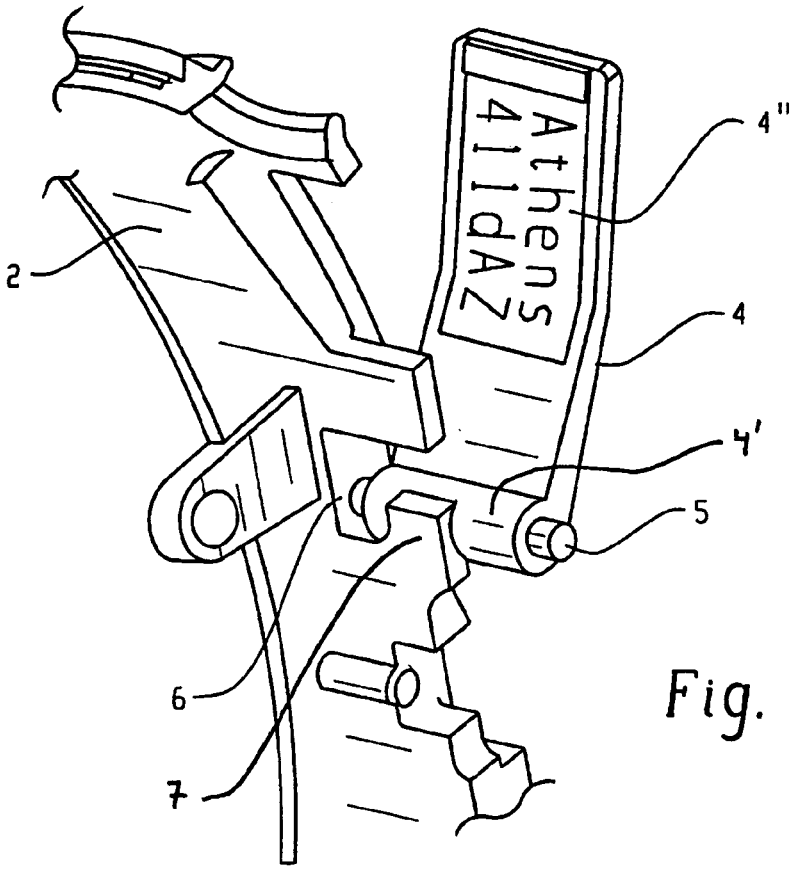
FIG. 4 is a view of a partly sectional view according FIGS. 2 and 3 with the cap in its partly opened state.

A resilient clip 7 is provided in this area of the front shell 2, which clip 7 comes into resilient contact against the underside 4' of the cap 4. If the underside 4' of the cap 4 consists of a rounded shape, a snap-in connection will thus be provided between the cap 4 and the front shell 2. The underside 4' of the cap 4 consists advantageously of a cylindrical shape and the clip 7 consists of an accordingly shaped recess, thus building a hinge for the cap 4, as may be seen in FIG. 4.

The cap 4 may not be pulled out to the outside of the front shell 2 as the pins 5 are held firm but pivotable in the grooves 6. After the opening of the housing by separating both of the back shell 1 and the front shell 2, the cap 4 may easily be assembled or disassembled. The cap 4 consists preferably of a single piece and may thus be easy and cost efficient manufactured.

It is further possible to provide visually ascertainable information on the inner side 4" of the cap 4, such as labeling, engraving or etiquettes with information concerning the hearing device, e.g. in form of a bar code.

I claim:

1. Housing for hearing devices or hearing aids respectively comprising: sound amplifying components arranged at the inside of the housing, at least one opening (3) arranged on the housing and a removable cap (4) for covering said opening (3), whereby the cap (4) is a one-piece element with outwardly protruding pins (5), and grooves (6) are provided in the vicinity of the opening (3) with dead stops, wherein said cap is insertable from the inside to the outside of the housing through the opening, and said pins (5) are insertable into the grooves (6) from the inside of the housing but are jammed from being pulled outside of the housing by said dead stops.

2. Housing according claim 1 whereby a part of the cap between the pins (5) consists of a rounded shape or at least partially a cylindrical shape.

3. Housing according claim 1 whereby the pins (5) are arranged on the cap (4) protruding from the cap as one pivotal axis.

4. Housing according claim 1 whereby at least one clip (7) is resiliently arranged on the housing, the clip (7) being at least partially in resilient contact with the cap (4) in its inserted state and thereby forming a part of a pivotal hinge of the housing.

5. Housing according claim 4 whereby the clip (7) is in contact with the cap (4) between the pins (5).

6. Housing according claim 4 whereby the clip (7) is provided as part of the housing.

7. Housing according claim 1 whereby the housing consists of at least two detachable housing shells (1, 2).

8. Housing according claim 7 whereby the shells (1,2) consist of plastics.

9. Hearing device or hearing aid with the housing according to one of claims 1 to 8.

* * * * *